US005623840A

United States Patent [19]

Roell

[11] Patent Number: 5,623,840

[45] Date of Patent: Apr. 29, 1997

[54] PROCESS FOR PRODUCTION OF WEAVE-KNIT MATERIAL

[75] Inventor: Friedrich Roell, Buberach, Germany

[73] Assignee: Tecnit-Technische Textilien und Systeme GmbH, Germany

[21] Appl. No.: 544,142

[22] Filed: Oct. 17, 1995

Related U.S. Application Data

[63] Continuation-in-part of Ser. No. 370,441, Jan. 9, 1995, abandoned, which is a continuation-in-part of Ser. No. 89,112, Jul. 8, 1993.

[30] Foreign Application Priority Data

Jul. 8, 1992 [CH] Switzerland ..... 02149/92

[51] Int. Cl.[6] ..... D04B 7/14; D04B 15/56

[52] U.S. Cl. ..... 66/190; 66/64

[58] Field of Search ..... 66/190, 194, 60 R, 66/61, 64; 139/383 B, 453

[56] References Cited

U.S. PATENT DOCUMENTS

| | | | |
|---|---|---|---|
| 3,178,910 | 4/1965 | Hammerle | 66/190 X |
| 3,348,389 | 10/1967 | Platnick | 66/61 X |
| 3,879,964 | 4/1975 | Pascual | 66/190 X |
| 3,884,053 | 5/1975 | Neiderer | 66/190 X |
| 3,961,498 | 6/1976 | Braunschweiler | 66/190 X |
| 4,872,323 | 10/1989 | Wunner | 66/190 X |
| 5,285,661 | 2/1994 | Mathieu | 139/383 B X |
| 5,400,834 | 3/1995 | Lewyllie et al. | 139/453 |
| 5,417,087 | 5/1995 | Marcello et al. | 66/60 R X |

FOREIGN PATENT DOCUMENTS

| | | | |
|---|---|---|---|
| 415512A1 | 3/1990 | European Pat. Off. . | |
| 1597954 | 8/1970 | Italy | 139/383 B |
| 503818 | 4/1971 | Switzerland | 139/383 B |
| 910885 | 3/1982 | U.S.S.R. | 139/383 B |
| 9319234 | 3/1993 | WIPO . | |

*Primary Examiner*—John J. Calvert
*Attorney, Agent, or Firm*—Ostrolenk, Faber, Gerb & Soffen, LLP

[57] ABSTRACT

A process for the manufacture of knitted goods with integrated weft and/or warp threads on a knitting machine having at least one needle bed by way of an actuatable thread guide which is movable in a controlled manner in the direction of the needle bed independently of a thread guide of a knitting feed system of the knitting machine. In the process, a thread is fed to a knitting region of the knitting machine by the thread carrier, which is guided along the needle bed in order to insert a warp thread corresponding to a desired length over several needles. The thread is inserted without intermeshing into the knitting region by the insertion of a warp thread over several courses of loops of the knitted goods, and remains in place without the thread being laid on tuck or intermeshed, and by the insertion of a diagonally extended thread, is moved along the needle bed during the formation of the loops of the knitted goods in the knitting machine.

8 Claims, 8 Drawing Sheets

PROCESS FOR PRODUCTION OF WEAVE-KNIT MATERIAL

CROSS-REFERENCE TO RELATED APPLICATION

This is a continuation-in-part of application Ser. No. 08/370,441 filed on Jan. 1, 1995, abandoned which is a continuation-in-part of Ser. No. 08/089,112 filed on Jul. 8, 1993.

BACKGROUND OF THE INVENTION

The present invention in general relates to a process for the production of a novel knitted material with integrated weft and/or warp threads or yarns and is based on a novel apparatus which makes it possible to feed a thread at any desired point of the needle bed independently of the actuation of a traditional thread guide of a knitting feed system in the knitting region of the knitting machine. Such a knitting feed system is generally formed in the known machines by the cam carriage for the actuating of the needles. The known thread or yarn guide of the knitting feed system serves to guide a thread into the knitting region of the needles so that this thread can be intermeshed with the loops already hanging on the needles so as to form the knitted material.

SUMMARY OF THE INVENTION

The process of the invention involves an apparatus, on the other hand, comprising at least one thread or yarn carrier which is movable independently of this known thread guide of a knitting feed system, it being movable by means of a guide carriage on a guide along a needle bed. Furthermore, the thread carrier contains a thread guide member in order to feed a thread to the knitting region of the knitting feed system. The actuating of the thread carrier, i.e. of the guide carriage and of the thread guide member is governed by means of a control, preferably a microprocessor control.

Such a thread carrier can be provided not only on traditional knitting machines but also on new knitting machines which have a linear needle drive, i.e. in which each needle can be moved individually by a separate actuator into knit position and tuck position. In the following, the feeding of a thread is always described. However, it should be made clear that what is stated applies in the same way to parallelly extending or twisted groups of yarn which can be introduced by the thread carrier instead of an individual thread.

By a correspondingly narrow construction, several thread carriers which are movable independently of each other can be guided parallel to each other in the vicinity of the knitting region of the knitting machine so that traditional threads for the formation of loop and tuck, as well as weft, warp, and diagonal threads can be fed simultaneously.

It depends of the control of the thread carrier whether the thread is inserted as weft, warp or diagonally. If, for instance, the thread carrier is moved over a part of the needle bed without needles being simultaneously pushed out into tuck or loop position, a weft is obtained. If the thread carrier is allowed to stand at a place and the thread or group of threads is fed within or outside of the loop into the knitting region then, with continuous fed knitting, a warp thread is obtained. On the other hand, if the knitting is continued during the movement of the thread carrier along the needle bed, a diagonally extending thread is obtained the inclination of which can be adjusted in accordance with the movement, i.e. the specific positioning of the thread carrier. It is, of course, also possible to form a weft, warp, or diagonal thread from a traditionally intermeshed thread in the manner described above and to continue the intermeshing again at any desired time. Weft, warp, or diagonal threads would thus be formed from the basic loop structure.

There are various possibilities for fixing the thread in the knitting. For example, the thread can be inserted between the needles of the two needle beds in the case of double-face knitting, for instance ribbed fabric. In this case, for instance, the two faces are knitted on two needle beds, only every second needle on each needle bed being used and an active needle of the one bed being opposite an inactive needle of the other bed. After the insertion of the thread, the loops are now transferred crosswise, and in this way the inserted thread is bound in place. In the case of single-face knitting, loops can be laid out on an auxiliary bed, the thread inserted, and the laid-out loops again taken up. In the case of double-layer knits which are connected by pile links, the thread can be inserted between the layers and be fixed in position by the pile links. In all types of knitting, the weft can furthermore be tied with tuck at any desired place and, if the needle serves only for the tuck fixing, loosened at any desired place by the pressing-off of the tuck loop.

As an alternative or in addition, it is possible, after a certain desired number of loops or wales, depending on whether a weft or a warp is concerned, to hold the thread only by the loop, fix it as laid-on tuck, or intermesh it with the loop base structure. In the case of on-tuck-laying, the thread is inserted by the thread carrier into the partially extended needle, so that the inserted thread, together with the last loop lies on the following retracted needle. Upon the intermeshing, the thread is inserted into the completely outwardly extended needle so that, upon the return travel of the needle, this thread is pulled through the loop of the knitting and thus becomes a part of the knitting. By the above-described possibilities of intermeshing or tucking, the weft, warp or diagonal threads are fixed in the knitting also in the case of single-layer or single-face knitting. As an alternative to this, it is possible to lay the thread to be inserted alternately in front of and behind, or on and between, the successive needles, as a result of which the inserted thread (in the case of the weft) is moved past the loops once on the front side and once on the rear side of the knitting. This technique can also be used in the case of double-face/double-layer and single-face/single-layer knitting, particularly in the case of multi-face/multi-layer knitting.

The thread carrier preferably has a thread feed device which can be governed by a control. By means of the thread feed device, which has a thread advance mechanism, the thread can be advanced in the direction towards the knitting region of the knitting machine and in this way, for instance, be gripped by a needle of the needle bed.

The thread feed device can be formed by any desired small drives which make it possible to push a thread forward by a desired distance. One embodiment of a thread carrier has a motor-driven drum on the outside of which the thread is detachably held by frictional adherence. By controlled rotation of the drum, the thread is pushed forward. On the other hand, the thread is held so loosely on the drum that, upon rapid insertion of the thread, it can slide over the periphery of the drum. However, it can also be provided that insertion of the thread by the drum drive be effected by motor drive, in which case the thread must not slide on the drum or be substantially less slidable on it. Another thread feed device consists of two clamps which are movable relative to each other. In this case, the clamps are moved towards each other, the thread is gripped by the clamp which is furthest towards the front in the path of the thread, and this clamp is pushed in the direction towards the clamp lying in the direction of the knitting region, which clamp is then loosened. In addition to these two embodiments which have been described, the person skilled in the art will be aware of still other feed devices which he can readily establish based on his knowledge in the field of small drives.

The thread feed device makes it possible to start the feeding of the thread by the thread carrier at any desired place in the knitting.

In one advantageous embodiment in which the thread carrier is used with a cutting device which can also be governed by a control, it is possible not only to have the thread start at any desired place, but also to have the inserted thread end at any desired place by simply cutting it by the cutting device.

At this point, it should be made clear that a central control can be provided which centrally controls all drives of the thread carrier, such as, for instance, the drive of the guide carriage, the drive of the thread feed device, and the drive of the cutting device. For this purpose it may be necessary to provide devices of known type which report to the control the position in which the parts driven towards each other are. For example, the guide over which the guide carriage slides can have a magnetic or mechanical marking which is read by a corresponding sensor on the guide carriage. This information must be fed to the control in order that the thread carrier can be actuated in accordance with a desired program. Of course, it is necessary in this connection to provide a device which provides the control with information as to the actuating of the needles of the needle bed. This can, on the one hand, be a position sensor which transmits the position of the cam carriage to the control or, in the case of a novel knitting machine with linear motor, this information is provided by the control of the knitting machine itself since each needle is individually controlled separately by the control. By detection of the activity of the needles of the knitting machine and of the activity of the thread carrier, the activity of the thread carrier can be correlated to the activity of the knitting machine in order, in this way, to effect a desired insertion of the thread either in weft direction, warp direction, or diagonally.

The weaving-together of warp and weft threads during the production of a knitted fabric is particularly advantageous. For this purpose, for example, two parallel guides are developed above the needle bed. On one guide there are provided a plurality of thread carriers which remain more or less in place and bind warp threads to the knitted fabric. Somewhat below the first guide for the warp-thread guide a smaller weft-thread carrier can be provided which is moved back and forth along its guide upon each knitting through of a row. The thread guide members of the warp-thread carriers of the upper rail can now be pivoted on the guide carriage, tiltable around an axis which extends parallel to the needle carriage, as a result of which the thread feed region of the thread guide member can be placed once in front of and once behind the weft-thread carrier. In addition, it can be provided that the thread guide member can be swung up or be adjustable in length so that the thread guide member can be swung over the lower guide of the weft-thread carrier. In this way, a woven fabric consisting of weft and warp threads which are woven together can be integrated in the knitted fabric during the knitting process. It is clear that this technique affords enormous possibilities, specifically in the field of industrial textiles.

A micro-length furnishing wheel for the thread is provided on the guide carriage or on some other part of the thread carrier, so that the tension of the thread fed can be maintained at a substantially constant level.

The process of the invention will be described below with reference to devices for the carrying out of the process, in which connection it should be clearly understood that the process is not limited to the use of these devices but can vary within the scope of the claims appearing at the end hereof.

Other features and advantages of the present invention will become apparent from the following description of the invention which refers to the accompanying drawings.

DETAILED DESCRIPTION OF THE INVENTION

Figure 1:
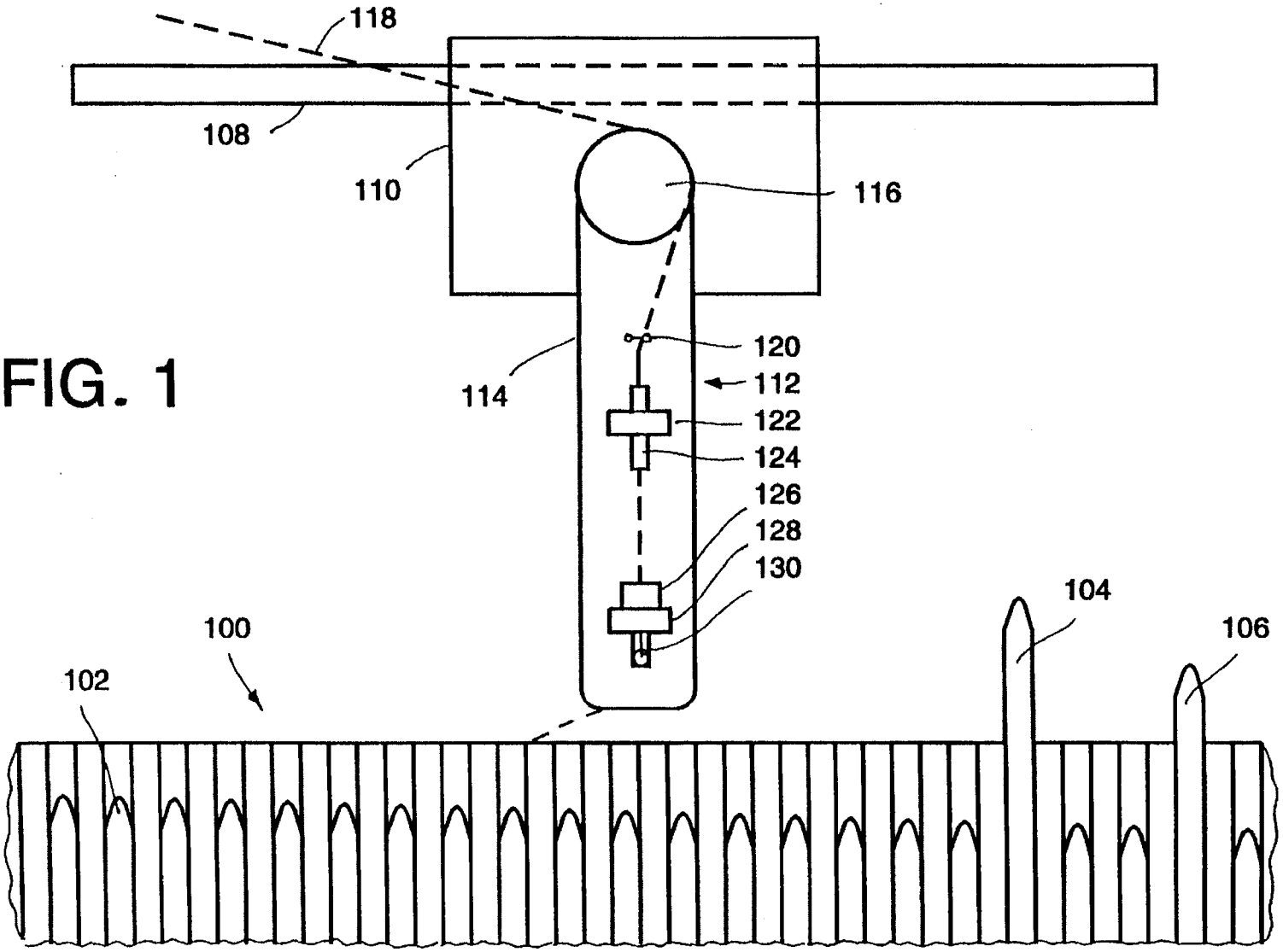
FIG. 1 is a side view from the front of a thread carrier guided over a needle bed for the feeding of a thread.

FIG. 1 is a front view of the front needle bed 100 of a V-shaped needle bed of a flat knitting machine. Of course, the process can also be applied to knitting machines which have only one needle bed or which have several, for instance, four needle beds. The needles 102 are either controlled individually by a linear drive or by a traditional conventional cam carriage such as shown for a V-shaped two-bed machine in FIG. 3. The reference numeral 104 indicates a needle which is moved out into knitting position, while reference numeral 106 indicates a needle which is moved out into tuck position. The knitting region of the knitting machine lies above the needle bed 100 in the region of the extended needles. Above the needle bed 100 a guide rail 108 is developed parallel to the needle bed. Along this guide rail 108 a guide carriage 110 can be moved in the longitudinal direction of the needle bed. The guide carriage 110 is a part of a thread carrier 112 which, in addition to the carriage 110, has a thread carrier member 114 which is fastened to the carriage 110 and extends vertically down from it in the direction towards the knitting region of the knitting machine. The thread carrier 112 furthermore contains, at the articulation point of the thread guide member 114 on the guide carriage 110, a micro-length furnishing wheel 116 which stores several turns of thread on a drum and has a spring device in order to be able to compensate for differences in tension acting on the thread 118. The thread 118 is directed to the micro-length furnishing wheel 116 by a yarn roller which is positioned in fixed position somewhere in the region of the frame of the knitting machine, the wheel seeing to it that the thread is fed by the yarn roller upon movement of the guide carriage in the two directions remains to some extent under tension. From the micro-length furnishing wheel 116, the thread is fed to a guide eye 120 and from there to a first clamping device 122 which is held movable axially to the thread guide member 114 in a longitudinal guide 124. The thread is guided by this first clamping device 122 to a second clamping device 126, which follows a cutting device 128. Behind the cutting device, the thread enters into the feed region 130 of the thread guide member 114.

The action of the thread carrier will be explained in further detail below.

The guide rail 108 contains (in a manner not shown in the drawing) two axially extending gripping ledges which serve to control the motor arranged in the guide carriage and to determine the position of the guide carriage 110 on the guide rail 108. Of course, all other customary carriage drive systems are conceivable, such as an endless-belt drive controlled by stepping motor, etc. At any desired location on the needle bed 100, the thread 118 can be fed into the knitting region. For this purpose, the first clamping device 122 moves in the guide 124 to the upper stop of the latter and firmly clamps the thread 118 which up to then has been held by the second clamping device 126. The second, lower clamping device 126 is now released and the upper first clamping device 122 is moved downward in the guide 124 in direction towards the feed region 130 of the thread guide member 114. In this connection, the thread is pushed out of the thread guide member 114 into the knitting region of the knitting machine from where it can be placed on tuck in, for instance, a needle 106 or be intermeshed (sunk). The guide carriage is now moved a desired distance along the needle bed, in which connection the thread can be simply laid in the knitting region without being intermeshed. For the fixing of the thread at certain distances apart, it is possible to place the thread again on tuck in accordance with needle 106 or to sink it in accordance with needle 104. The guide carriage 110 can also be stopped at any desired location. If the knitting process is then to be continued, the thread fed, which is now stationary, forms a warp thread in the continuously knitted knitted fabric. The guide carriage 110 can then be moved in the opposite direction, whereby a meander-like structure is produced. It is also possible to guide the thread diagonally, in the manner that the thread carrier 112 is moved slowly along the needle bed 100 by means of the guide carriage 110, while the knitting process is continued.

The thread can be cut at any desired location in the manner that the lower, second clamping device 126 is actuated in such a manner that it clamps the thread fast and the cutting device 128 is so actuated that it cuts the thread. In this way, several separate threads can be inserted one behind the other within one pick, which otherwise would be possible only with several separate thread carriers. The same is true of the insertion of warp threads.

It should be mentioned here that, instead of one thread carrier, several thread carriers can also be provided on one guide or on several parallel guides, in which case thread carriers on one guide are movable only to a limited extent independently of each other, while thread carriers on guides which are arranged parallel to each other can be controlled entirely independently of each other. It is obvious that by the technique described above, patterns and combinations of knitted and woven fabrics can be produced, as desired, with one or more thread carriers.

It is furthermore possible to guide several threads via one thread carrier or to arrange several thread guide members which can be actuated independently of each other on a single carriage, either alongside of each other and/or on the front and rear sides.

Figure 2:
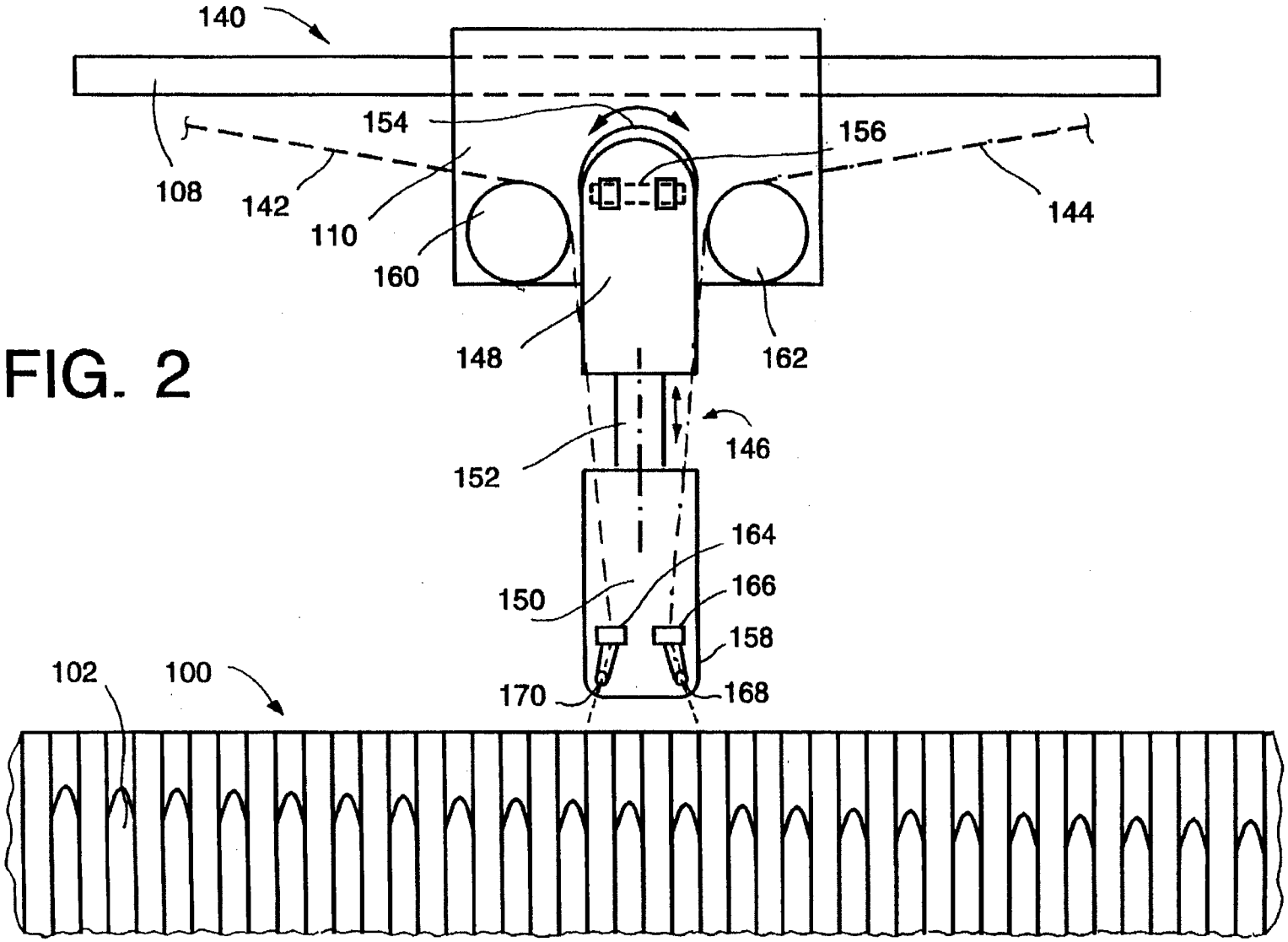
FIG. 2 is a view in accordance with FIG. 1 of a thread carrier with a rotatable, swingable and tiltable thread guide member which is adjustable in its length, for the independent feeding of two threads.

FIG. 2 shows a further developed form of the thread carrier of FIG. 1. Identical parts or parts having the same function are provided with identical reference numerals. FIG. 2 also shows a needle bed 100 with needles 102, a guide rail 108 extending above the needle bed 100 parallel to it, and a guide carriage 110, movable along the guide rail 108, as part of a thread carrier 140 for the feeding of two threads 142, 144 by a thread guide member 146 which is movable with several degrees of freedom. The thread guide member 146 consists of an upper part 148 which is connected to the guide carriage 110, and of a lower part 150, which is connected to the upper part 148 via an axial guide 152. By means of the axial guide 152, the lower part 150 of the thread guide member 146 on the upper part 148 is movable to and away from the upper part 148, as indicated by the arrow shown. In addition, the lower part 150 is turnable by means of the axial guide 152 by 90° in axial direction relative to the upper part 148. The upper part 148 is swingable by means of a swivel joint 154 around a horizontal swivel axis transverse to the direction of the needle bed, as indicated by the arrow shown. In addition, the upper part is arranged on the guide carriage 110 tiltable around a pin 156 which extends in the direction of the needle bed so that the feed region 158 provided at the lower end of the lower part can be tilted in front of the extended needles of the needle bed 100 or behind the extended needles of the needle bed 100. The two threads 143, 144 are guided from a yarn roller, connected in fixed position to a knitting machine, possibly with furnishing wheel, to thread feed devices 160, 162, said thread feed devices having a separate rotary drive. These rotary drives 160, 162 not only have a thread storage for the equalizing of thread tensions, but also a motor-driven thread advance. From there, the threads 142, 144 travel to separate cutting/clamping devices 164, 166 by which the two threads can be clamped and cut independently of each other. The threads pass into the knitting region of the machine via separate thread feeds 168, 170 within the feed region 158 of the thread guide member 146.

By a rotation of the lower part 150 of the thread guide member 146 by 90° , the thread feeds 168, 170 which are now arranged alongside of each other are turned in front of and behind the plane of the drawing, as a result of which they lie in front of and behind an extended needle respectively. By rotation of the lower part of the thread guide member 146, it can thus be determined whether the thread to be inserted is placed in front of or behind the needle or into the needle. By the moving upward of the lower part 150 of the thread guide member 146, the total length of the thread guide member 146 can be shortened, as a result of which the feed region 158 of the thread guide member 146 is moved out of the knitting region. In addition, the thread advance can be supported by the rotary thread feed devices 160, 162.

Upon the insertion of a warp thread, i.e. with the guide carriage 110 stationary, the feed region 158 can be placed on the one hand to the right and on the other hand to the left alongside the stitch wales by a swinging of the thread guide member 146 around the swivel joint 154, as a result of which the warp thread can be secured in the knitted fabric. Otherwise, the manner of operation of the thread carrier shown in FIG. 2 is identical to the manner of operation of the thread carrier 112 of FIG. 1. Of course, two threads 142, 144 can be fed independently of each other with the thread carrier shown in FIG. 2.

In the case of the two figures shown, the actuating means for different devices, such as thread guide devices, clamping and cutting means, and the guide carriage drive, have not been shown, nor the connecting of these actuating members to a central control which has also not been shown.

Figure 3:
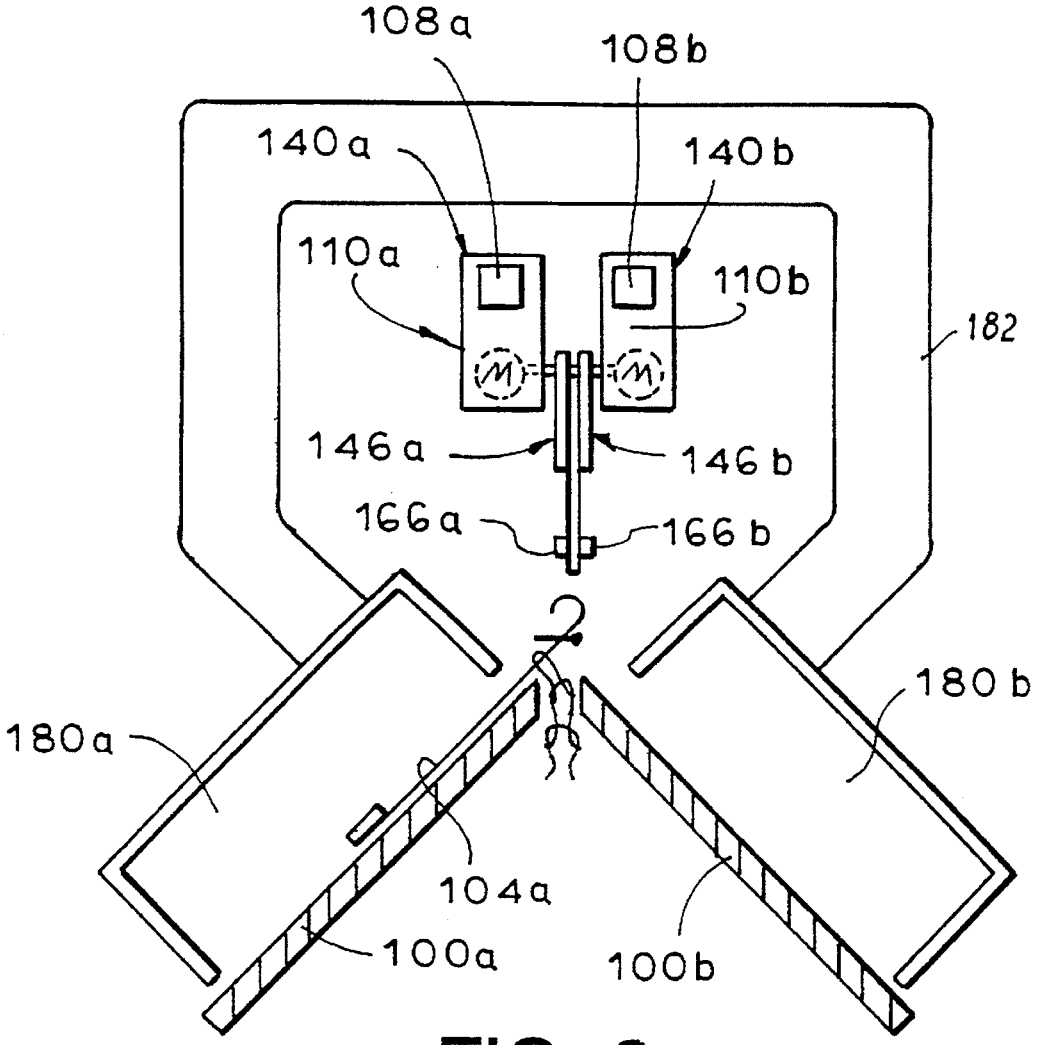
FIG. 3 is a greatly simplified cross section through the arrangement of FIG. 2, with two thread carriers moved in parallel.

FIG. 3 is a cross section through a two-bed knitting machine with needle beds arranged in V-shape. The technical features of FIG. 3 are designated by reference numerals identical to FIG. 2 insofar as identical part or parts having the same function are concerned. However, it should be pointed out here that the drawing is extremely diagrammatic and serves only to explain the interplay of cam carriages of a traditional knitting machine with the new thread guides. The figure clearly shows the V-position of the two needle beds 100i a, 100*b* of the two-bed machine. Can carriages 180*a*, 180*b* are movable on these two needle beds 100*a*, 100*b* respectively. The two cam carriages 180*a*, 180*b* are connected to each other by a bow 182. In this way, the interconnected cam carriages 180*a*, 180*b* are moved back and forth simultaneously over the corresponding needle beds 100*a*, 100*b*, the actuating of the individual needles 102 being governed by program control. In the figure, a moving out of one needle 104*a* of the front needle bed into knitting position is shown, which has the result that the thread inserted is intermeshed. In general, the needles of the needle beds 100*a*, 100*b* are moved by the cam carriages between three different positions, as shown in FIG. 1. Either they are not moved out at all, or are moved somewhat out into a tuck position as indicated by the reference numeral 106 in FIG. 1, or they are moved out completely into a knitting position, as shown by the reference numeral 104 in FIG. 1. If they are moved into tuck position, then the thread inserted by the thread carriers 140*a*, 140*b* is placed only together with the present loop in the hook of the knitting needle. However, if the needle is moved out into knitting position, i.e. moved out to such an extent that the loop lying on the needle slides over the closing latch of the knitting needle, then the thread which is now inserted into the needle is intermeshed with the loop now lying on the neck of the needle upon the return into the rearward position (reference numeral 102 in FIG. 1), since upon the moving back of the needle the loop which up to now was lying thereon slides over the tongue of the needle so that the inserted thread forms the new loop in the head of the thread.

Each of the two guide rails 108*a*, 108*b* which are arranged parallel to each other within the bow 182, bears one or more thread carriers 140*a*, 140*b* which are movable independently of each other at least on the two different guide rails 108*a*, 108*b*. There are furthermore shown the downward extending thread guide members 146*a*, 146*b* of the thread carriers 140*a*, 140*b*, and the corresponding clamping/cutting means 166*a*, 166*b*. It should be made clear here that the thread carriers 140*a*, 140*b* are actually developed narrower, so that more than two rails can be arranged parallel to each other, so that, for instance, four groups of thread carriers which can be actuated independently of each other can be provided on four rails which extend parallel to each other. The rails may also differ from each other in their vertical position in a manner not shown in the drawing so that, for instance, the guide rails for guide carriers which are intended only for the insertion of the warp can be arranged further up, outside the knitting region, while the rails for the thread carrier for the insertion of the weft or warp are arranged further below.

Figure 4:
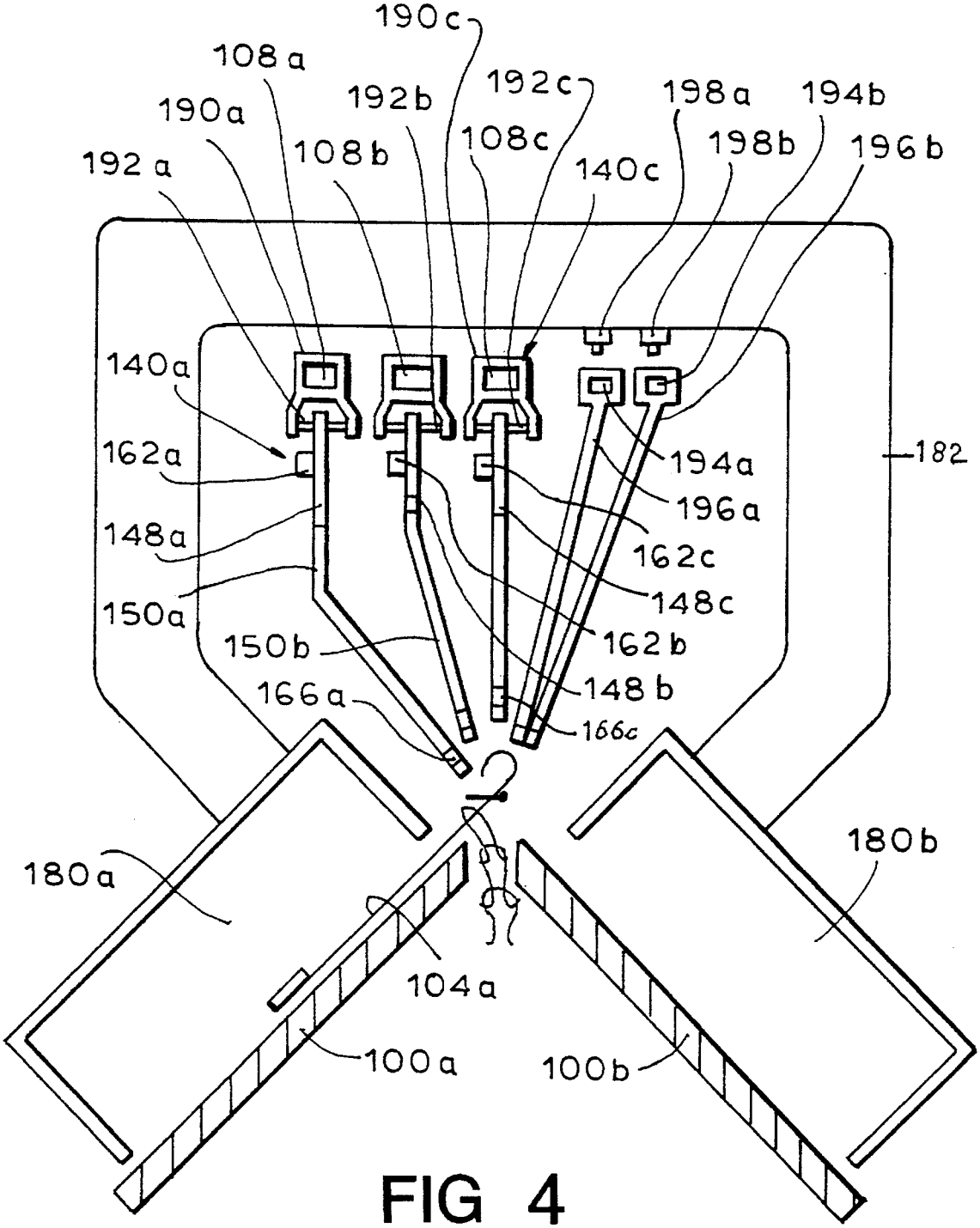
FIG. 4 is a cross section, as in FIG. 3, of another embodiment of the invention with two conventional thread guides of the knitting feed system and three thread carriers in accordance with the invention.

FIG. 4 is a cross section similar to FIG. 3 through an alternative embodiment for the carrying out of the process of the invention. This figure serves to show the interplay of known thread guides of knitting systems and the independent thread carriers used in the invention. Parts which are identical to the previous figures or have the same function have been provided with identical reference numerals.

Below the bow 182 for the connecting of the two cam carriages 180*a*, 180*b*, there are arranged, parallel to the needle bed, three guide rails 108*a–c* which are designed for guiding independently movable thread carriers 140*a–c*. The thread carriers 140*a–c* are, in principle, of the same construction as the thread carrier of FIG. 2, with the difference that the guide carriages 190*a–c* of the thread carriers 140*a–c* have guides 192*a–c* arranged horizontally transverse to the needle bed, the upper part 148*a–c* of the thread guide members being displaceably guided by a control on said guides 192*a–c*. In this way, the feed regions of the thread guide members can be guided, alternatively or in addition to the tilting mechanism 156, in front of or behind the region of emergence of the needles.

To the right alongside the three guides 108*a–c* there are two guides 194*a,b* for conventional known thread guides 196*a,b*. These thread guides 196*a,b* can be connected by controlled bolts 198*a,b* arranged on the bow 182 to the bow and thus also to the cam carriages 180*a,b*. Upon actuating of the bolts 198*a,b*, they, upon passage of the bow 182, engage into grooves or depressions (not shown) which are provided on the thread guides 196*a,b* above the guide rails 194*a,b*. The thread guides 196*a,b* are then carried along with the cam carriage 180*a,b* until they are again released from their connection to the bow 182 by another actuation for the withdrawal of the bolts 198 *a,b*. The conventional thread guides can insert a thread in tuck or for intermeshing into a needle which has been moved out accordingly to a greater or lesser extent. However, they cannot guide the thread in front of or behind a needle.

Figure 5:
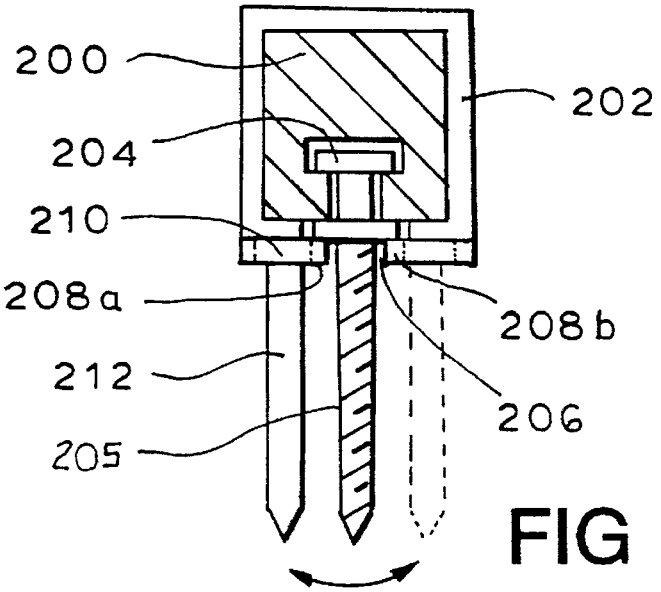
FIG. 5 is a cross section through a guide rail for the independent guiding of two different thread carriers or thread-carrier groups.

FIG. 5 shows a double-rail system for the simultaneous, independent guiding of two different thread carriers. The guide rail 200 shown in FIG. 5 has a square cross section. On its periphery, its guides a downwardly open first guide carriage 202 which is movable along the guide rail. On its bottom side, the guide rail 200 has an undercut developed in the form of a T which serves as mounting and guiding surface for a second guide carriage 204, on which a second thread guide member 205 extends vertically downward through an opening 206 in the first guide carriage 202.

On the bottom of the first guide carriage 202, on both sides of the opening 206, there are two guides 208*a,b* coaxial to each other, arranged horizontally transverse to the guide rail 200. These two guides 208*a,b* are open at the bottom and receive a guide part 210 from which a first thread guide member 212 extends downward.

The length of the guide part 202 in the direction of the guide 208*a,b* is greater than the width of the opening 206 in the same direction. In this way, the first thread guide member 212 can be displaced into the dashed-line position to the right of the thread guide member by means of an actuating member, not shown for reasons of clarity of the drawing, from the position shown to the left of the second thread guide member when the opening 206 is not blocked by a second thread guide member 205 passing by. The interaction of the first and second thread guide members 212, 205 can be correlated and controlled by a central control.

This embodiment is intended specifically for the insertion of woven warp and weft threads which is shown in the following figures. A group of several first thread guide members 202 arranged one behind the other on the guide rail 200 in the direction of the needle bed serves for the feeding of warp threads into the knitting region of a knitting machine, as already described in connection with the previous figures. The first thread guide members 212 are, in this connection, moved out in such a manner that alternately one thread guide member 212 always assumes the position shown on the left while the following thread guide member 212 assumes the dashed-line position shown on the right. The second thread guide member 205 acts as weft-insertion thread guide. When the second thread guide member 205 has once moved along the entire guide 200 and has thus entered a weft, the first thread guide members 212 are moved into in each case the other position in the guide 208*a,b*. The second thread guide member 205 for the introduction of the weft thread is now moved back again. In this way a weaving takes place between the inserted weft and warp threads. In addition, the formation of the stitches on the knitting machine can be continued in any desired manner. In this way, one or more woven weft threads can be entered within a row of loops. Of course, the first and second thread guide members 212, 205 can be developed in the same manner as the thread guide member 140 in FIG. 2, so that the warp and weft threads can be laid optionally in front of or behind the loops of a single-face knitted fabric (jersey/purl) and in front of, behind, or between the stitches of a two-face knitted fabric (rib).

Furthermore, the number of thread guide members per thread carrier is limited only by the limited miniaturizability of the technical components. The device can be realized on knitting machines having one, two, three, four or more beds without major conversions being necessary. Instead of the use of cam carriages, linear needle drives can also be used. The nature of the needle drive thus has no effect on the device of the invention.

FIGS. 6 to 9 show different loop patterns of knitted goods with incorporated warp and weft threads which can be produced with the devices described above with the use of the process of the invention.

Figure 6:
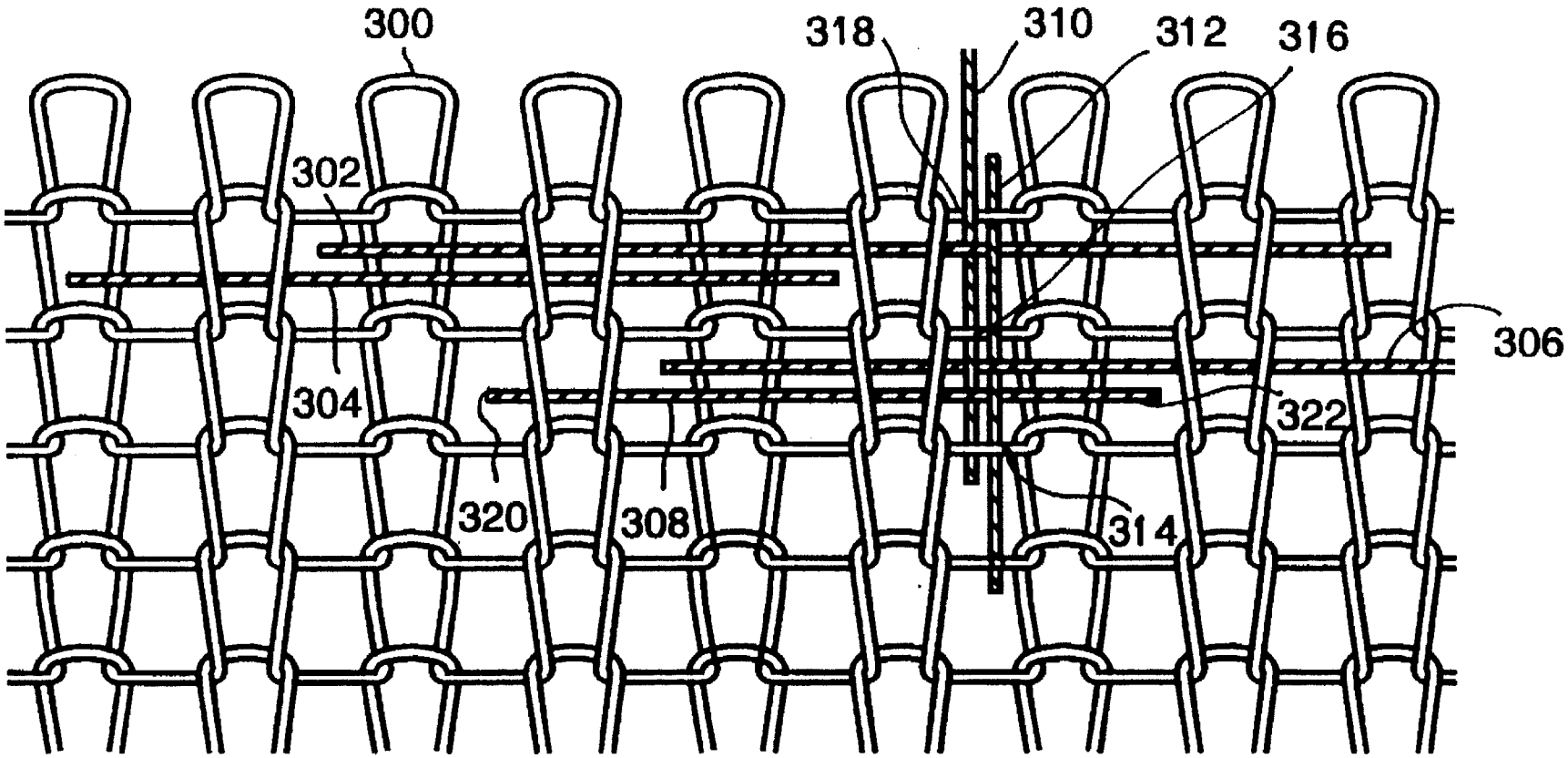
FIGS. 6 to 9 are views of different weave-knit structures which can be produced by the device in accordance with the invention.

FIG. 6 shows a two-face rib knit fabric 300 in which four weft threads 302, 304, 306, and 308 and two warp threads 310 and 312 have been introduced. The warp threads are introduced by two thread guides which are left standing closely alongside each other at one place of the needle bed. The right warp thread 312 is, in this connection, started earlier by about one course of loops than the left warp thread 310. While the feed regions of the two thread carriers are guided at the point 314 behind the knitting region, one course of loops is swung later to the feed region of the right thread guide for the introduction of the right warp thread 312 in front of the needles, so that the right warp thread 312 extends at the point 316 in front of the thread 300 of the knitted fabric while the rear warp thread 310 extends along the back of the knitted fabric. At the point of intersection 318 with the next knitted thread 300, the feed regions of the two thread carriers associated with the warp threads 310, 312 are swung alternately forward and rearward so that now the left warp thread 310 is guided in front of the loop thread 300, while the right warp thread 312 is guided behind the loop thread. Shortly behind the point of intersection 318, the right warp thread is cut off by a cutting device of the thread carrier, while the left warp thread is cut off somewhat later.

The insertion of the weft threads 302 to 308 is described below. First of all, the first weft thread is introduced behind the point of intersection 314 at the point 320. The weft thread is in this connection laid between the needles of the front and rear needle beds so that it lies, viewed in the direction of the course of loops, alternately in front of and behind a loop. Upon the passage by the warp threads, the thread feed regions of the thread carriers associated with the two warp threads 310, 312 can be so displaced that the weft thread travels alternately in front of and behind the warp thread. In this way, a woven structure is obtained, such as can be noted, for instance, between the two points 314 and 316. The first weft thread 308 extends approximately over four loops and is cut off at its end 322 by the cutting device of the corresponding thread carrier at the point 322. While the first weft thread 308 is still inserted, a second weft thread 306 is inserted one loop later so that it is displaced somewhat with respect to the first weft thread 308. This second weft thread 306 can also be cut off later by the cutting device of the corresponding thread carrier at any desired place. One course of loops later, the two weft threads 304 and 302 are inserted in similar manner. From FIG. 4 it is thus clear that, by a suitable control of the thread carriers, i.e. of the thread feed device of each thread carrier at the start of the insertion of the thread and the actuating of the cutting device at the end of the insertion of a thread and furthermore by a displacement of the feed region of the thread carriers in front of or behind the needles of a needle bed, any desired patterns, as well as woven structures, can be produced, which can be used both for decorative purposes as in FIG. 5 and, on the other hand, also for industrial purposes if the interweaving of warp and weft threads such as documented on basis of the threads 308, 306, 310, 312, is continued over a larger area. It is clear that such a strengthening of a knitted fabric leads to enormously high-strength weave-knit materials.

Figure 7:
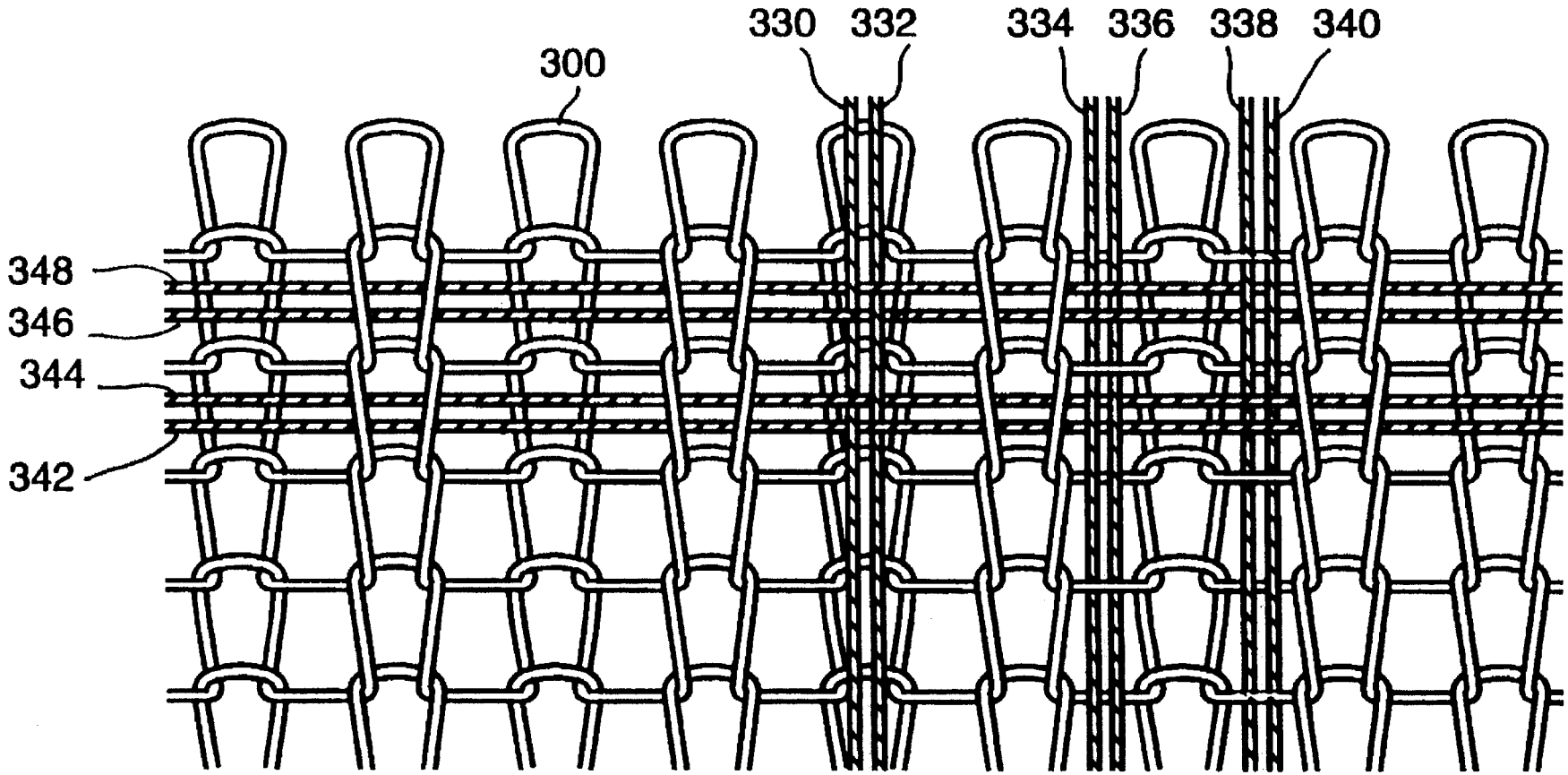

FIG. 7 shows a double-face rib knit fabric 300 as in FIG. 6. In the knit fabric there are three groups of in each case two warp threads 330, 332, 334, 336 and 338 and 340. Furthermore, the knitted material contains four weft threads 342, 344, 346 and 348. The left pair of warp threads 330, 332 is introduced either with two separate thread carriers which are left standing over the loop or with a thread carrier in accordance with FIG. 2 which is able to place the thread guide region of the two threads transverse to the plane of the drawing, i.e. in front of and behind the needles, in such a manner that the weaving obtained with the weft threads 342 to 348 can be realized, as already shown in FIG. 6 between the regions 314 and 316. The middle two warp threads 334, 336 and the right-hand warp threads 338, 340 can in each case be fed via a thread carrier according to FIG. 1 or 2 if two threads are fed rather than one thread. The middle two warp threads 334, 336 differ from the two right-hand warp threads 338, 340 in the manner that the two corresponding thread carriers are always swung in opposite directions so that the two pairs of warp threads are guided in each case alternately in front of and behind the loop in the direction of successive wales. Here also, it is thus necessary that the feed region of the thread carrier can be swung in front of and behind the needles of the needle bed. The weft threads are inserted as in FIG. 6 between the needles of the two needle beds.

Figure 8:
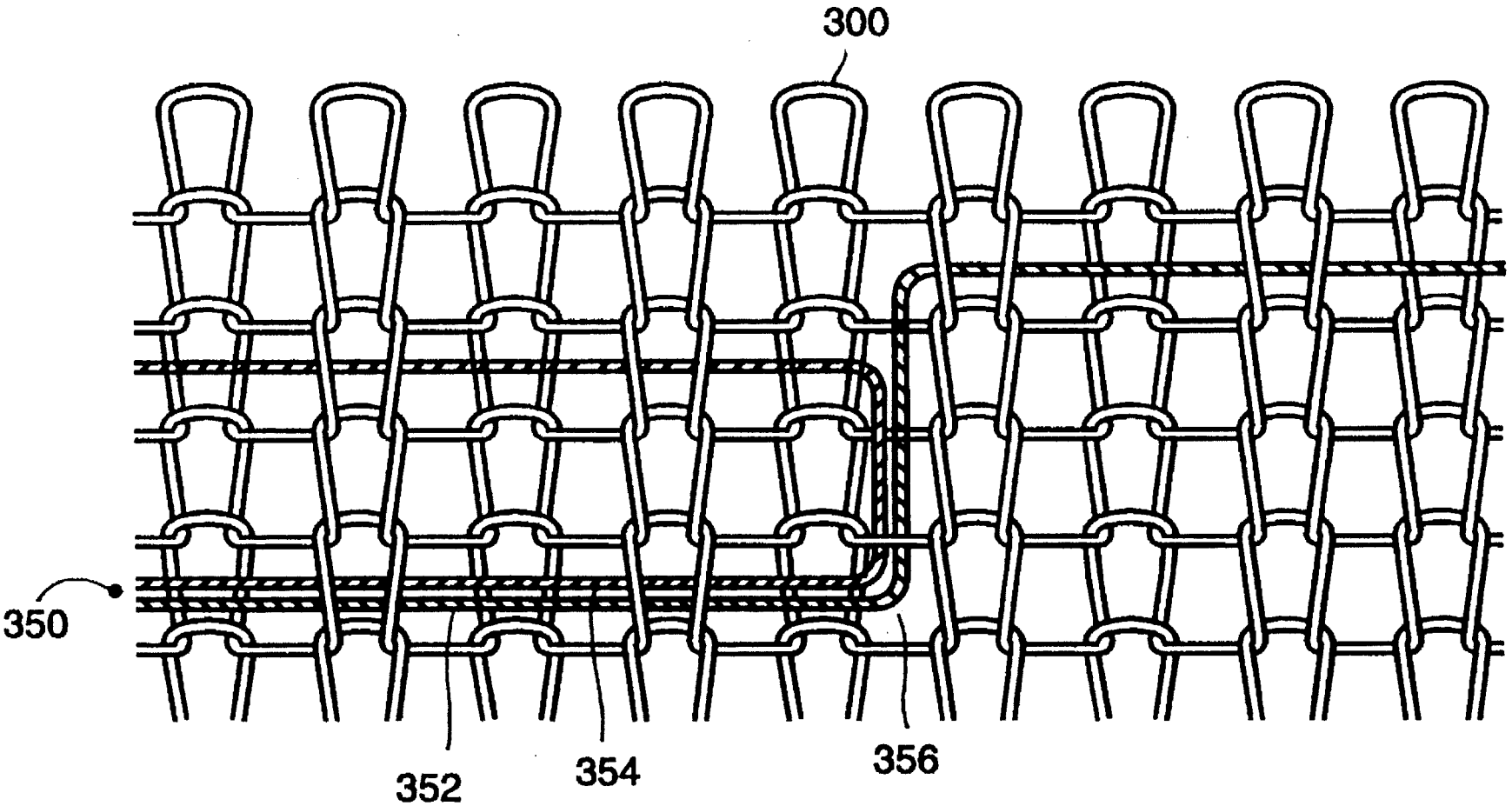

FIG. 8 shows that one and the same thread guide can be used both as weft thread guide and as warp thread guide. Again a two-face rib knit fabric 300 is shown. Coming from the left, two threads 352, 354 are inserted at the point 350 by two separate thread carriers between the needles of the two needle beds up to the point 356. At this point the two thread guides are left standing in order to temporarily continue the weft thread as warp thread. The knitted fabric is knitted further by courses of loops, whereupon the thread carrier for the thread 354 is again moved towards the left in order again to move the thread 354 as weft to the left. The thread carrier for the other thread 352 is still left standing until the next course of loops and then moved away toward the right, so that it also again acts as weft. It is thus clear that one and the same thread carrier, depending of the manner of its actuation, can insert one and the same thread as weft thread or as warp thread.

Figure 9:
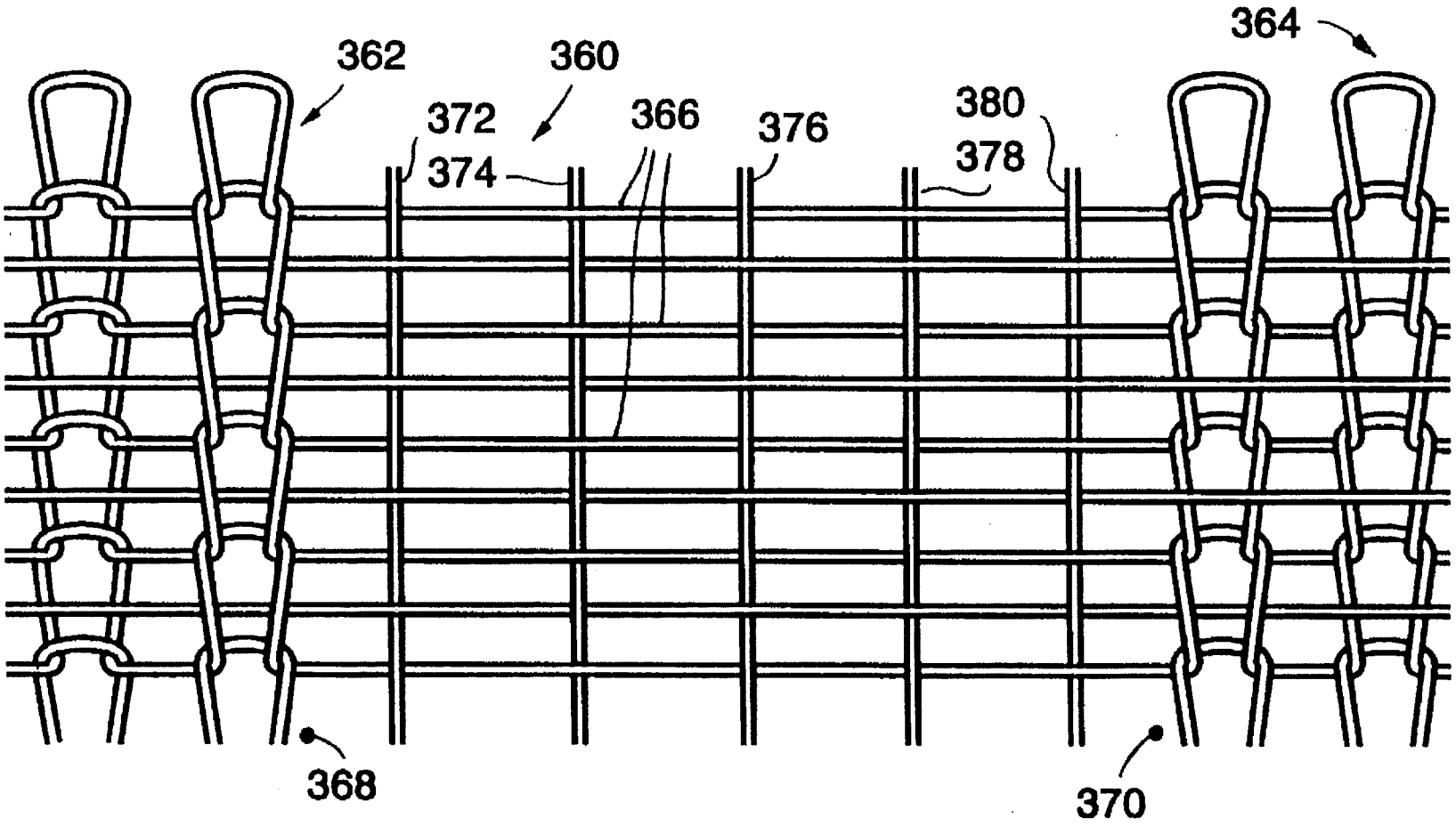

FIG. 9 shows the knitted fabric 360 which consists of two rib knit fabrics 362, 364 which are connected together by non-intermeshed threads 366. This is obtained simply in the manner that knitting is effected up to the point 368 on one needle bed. The thread is then guided by the thread guide of the knitting feed system up to the point 370 where further knitting is effected. In this way, there are produced knitted regions which are connected to each other by horizontal threads, which threads, however, in the final analysis, are identical to the threads which form the knitted fabric 360. By separate thread carriers, for instance according to FIG. 1, five warp threads 372 to 380 are now introduced into the region in which the thread which is introduced by the thread guide of the knitting feed system is not intermeshed. Now, a woven structure is produced, in the manner that the thread feeds, arranged one behind the other, of the thread carriers are moved alternately forward and backward for the introduction of the warp threads, so that, from course to course, they come to lie now in front of and now behind the horizontal threads 366. In this way, alternating regions of knitted structures and woven structures can be produced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process for inserting weft warp or weft and warp yarns in knitted goods on a knitting machine having at least one needle bed, the insertion being performed by at least one first yarn guide which is movable in a controlled manner in the direction of the needle bed independently of at least one second yarn guide of a knitting feed system of the knitting machine for feeding a yarn for knitting a base knit structure, the first yarn guide including a yarn feeding device for advancing the yarn into the knitting region and a cutting device for cutting the yarn, the process comprising the steps of:

actuating the yarn feeding device, at the beginning of yarn insertion, to advance the yarn to the knitting region whereupon insertion of the yarn starts, guiding the first yarn guide along the needle bed in order to insert the yarn corresponding to a desired length over several needles, and terminating the yarn insertion by actuating the cutting device of the first yarn guide.

2. The process according to claim 1, wherein the yarn inserted by the first yarn guide is cut at every desired location by control of the cutting device arranged on the first yarn guide.

3. The process according to claim 1, wherein the yarn guided by the first yarn guide can be laid at any desired location in the knitting region of the knitting machine by control of a yarn feed device which advances the yarn from the first yarn guide into the knitting region.

4. The process according to claim 1, wherein several first yarn guides are arranged parallel to each other and movable independently of each other and of a cam carriage, the first yarn guides being controlled by common control in order to obtain a desired pattern of weft, warp, or diagonal yarns.

5. The process according to claim 1, wherein the yarns inserted by the first yarn guide are tucked or laid into the base knit structure at desired distances apart.

6. The process according to claim 1, wherein upon the insertion of a yarn, the first yarn guide is placed, by a swinging of the first yarn guide, transverse to the needle bed, in front of or behind needles of the needle bed.

7. The process according to claim 1, wherein upon the insertion of a warp yarn, the first yarn guide is moved somewhat back and forth along the needle bed in order to lay the yarn alternately to the right and left of a wale.

8. The process according to claim 1, wherein inserted weft and warp yarns are interlaced with each other.

* * * * *